US012421657B1

(12) United States Patent
Sparks et al.

(10) Patent No.: US 12,421,657 B1
(45) Date of Patent: Sep. 23, 2025

(54) METHOD FOR MANUFACTURING PRINTED FABRIC FURNITURE COVERINGS

(71) Applicant: Nuvar Incorporated, Holland, MI (US)

(72) Inventors: Amy L. Sparks, Grandville, MI (US); Kurt R. Laansma, Hudsonville, MI (US); Eric Binnendyk, West Olive, MI (US); Nathan T. Konyndyk, Jenison, MI (US)

(73) Assignee: Nuvar Incorporated, Holland, MI (US)

( * ) Notice: Subject to any disclaimer, the term of this patent is extended or adjusted under 35 U.S.C. 154(b) by 0 days.

(21) Appl. No.: 18/593,898

(22) Filed: Mar. 2, 2024

Related U.S. Application Data

(60) Provisional application No. 63/488,273, filed on Mar. 3, 2023.

(51) Int. Cl.

| | |
|---|---|
| ***D06P 5/00*** | (2006.01) |
| ***A47C 31/12*** | (2006.01) |
| ***D06P 5/20*** | (2006.01) |
| ***D06P 5/28*** | (2006.01) |

(52) U.S. Cl.
CPC ..... *D06P 5/004* (2013.01); *A47C 31/12* (2013.01); *D06P 5/2055* (2013.01)

(58) Field of Classification Search
CPC ..... D06P 5/004; D06P 5/2055; A47C 31/12
USPC ..... 8/471
See application file for complete search history.

(56) References Cited

U.S. PATENT DOCUMENTS

| | | | | |
|---|---|---|---|---|
| 4,984,517 | A * | 1/1991 | Doublet | B44C 1/1716 101/470 |
| 6,224,707 | B1 * | 5/2001 | Lion | B32B 27/10 156/289 |
| 2005/0260378 | A1 * | 11/2005 | Bernabeu | D06Q 1/10 427/463 |
| 2006/0257618 | A1 * | 11/2006 | Pascual Bernabeu | D06P 5/004 427/463 |

FOREIGN PATENT DOCUMENTS

| | | | | |
|---|---|---|---|---|
| EP | 1738835 | A2 * | 1/2007 | D06P 5/004 |
| WO | WO 2012152281 | A1 * | 11/2012 | D06P 5/004 |

* cited by examiner

*Primary Examiner* — Eisa B Elhilo
(74) *Attorney, Agent, or Firm* — Frank M. Scutch, III

(57) ABSTRACT

A fabric furniture covering manufactured using the process of selecting printing pattern/photo or artistic design and then printing a first pattern to a first fabric by printing an image to a transfer paper using a reverse image or directly printing (future state) directly onto the material. A transfer paper is then laid on top of the first fabric in a continuous production process. Both heat and pressure are simultaneously applied such that an ink dye is transferred to the first fabric so to permanently dye the fibers to their core. A first blank material is then cut to a predetermined size and upholstered to furniture such as stools, ottomans, table, chair or sofas. A second pattern is also cut using a second fabric and the second printed fabric is cut to a size so to act as a removeable or replacement cover over the first fabric on the upholstered furniture.

4 Claims, 2 Drawing Sheets

200a

200b

METHOD FOR MANUFACTURING PRINTED FABRIC FURNITURE COVERINGS

FIELD OF THE INVENTION

The present invention relates generally to furniture upholstery and more specifically to printing images on furniture upholstery coverings for complete upholstery that envelopes an interior furniture product.

BACKGROUND

Printing images on fabric is well known in the art however fabrics which have images are typically not used in the furniture industry. Moreover, persons often like to use furniture coverings to protect furniture, however the coverings typically do not often match the required décor nor allow individuals to customize the design of the fabric. In addition, any customizable printing on an upholstered product is not interchangeable nor fully washable as it will be with this unique approach as detailed in this application. Accordingly, new upholstery solutions are needed to address these problems.

BRIEF DESCRIPTION OF THE FIGURES

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

Figure 1:
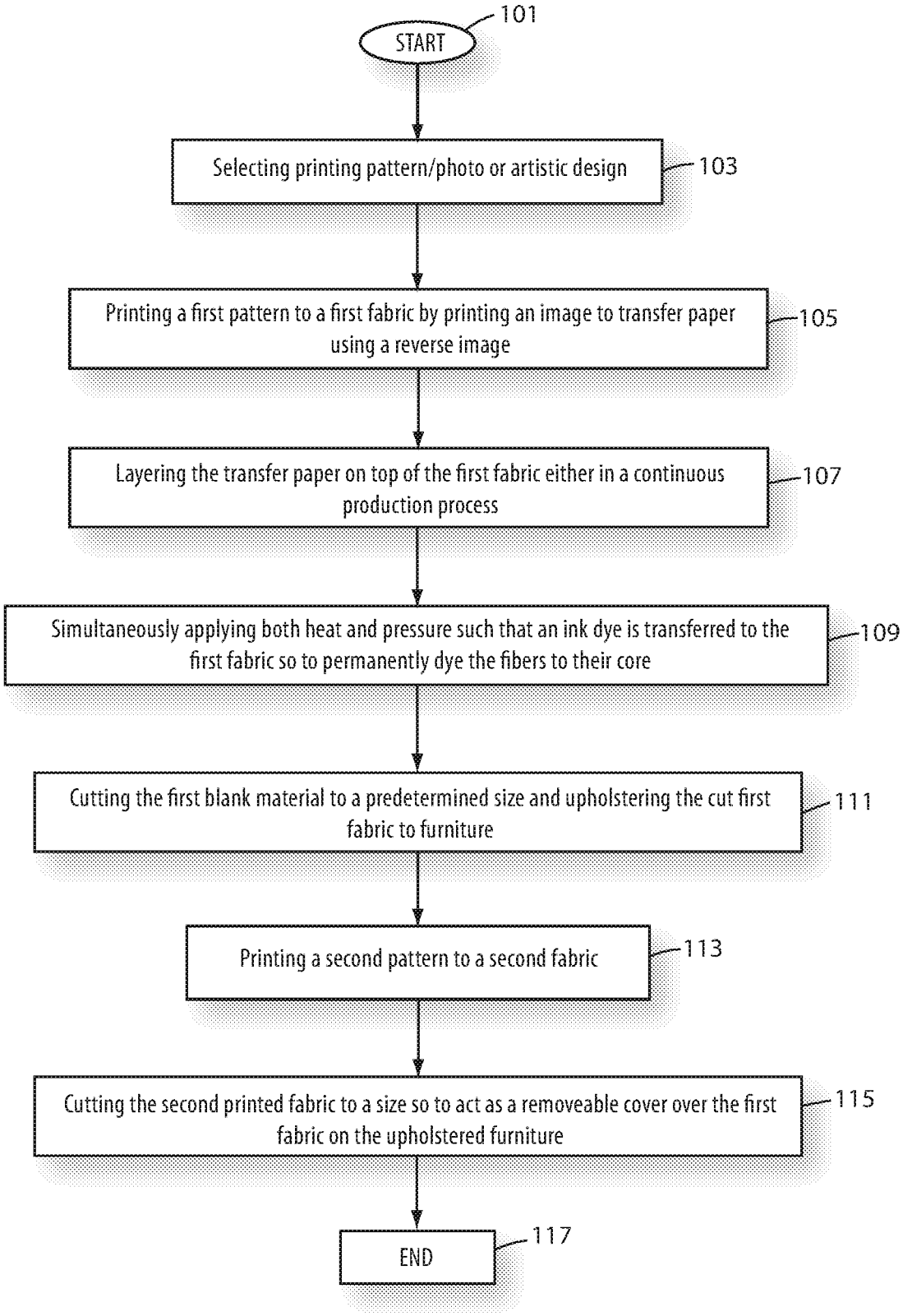
FIG. 1 is a flow chart diagram illustrating a method of manufacturing a printed furniture covering in the invention.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

Before describing in detail embodiments that are in accordance with the present invention, it should be observed that the embodiments reside primarily in combinations of method steps and apparatus components related to a method for manufacturing printed fabric furniture coverings. Accordingly, the apparatus components and method steps have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element.

FIG. 1 is a flow chart diagram illustrating the various steps used in manufacturing printed fabric furniture coverings for indoor furniture. The method begins 101 by providing a first blank material of seating grade fabric that is polyester based (50% or more) which allows the first blank material to be receptive to dye sublimation printing. A desired image is selected 103 which is at least one of a printed pattern, photo or artistic design. Dye sublimation printing has many benefits and features for enhancing a selected printing pattern/photo, image or artistic design 105. A first image or pattern is transferred to a first fabric by printing 107 an image to a transfer paper using either a reverse image or through a dye sublimation process. An advantage in using the dye sublimation process is that it is a single step process that allows the image to be directly printed and/or transferred to the fabric in a single step.

If a two-step process is desired, a transfer paper is laid 109 on top of the first fabric either individually or in a continuous production process. Both heat and the required amount of pressure are simultaneously applied 111 to the fabric for a predetermined time such that an ink dye is transferred to the first fabric so to permanently dye the fibers to their core. Whether a one or two step process is used to transfer the image to the fabric, a first blank material is then cut 113 to a predetermined size and then the cut first fabric is upholstered to a stool, table or other furniture. A second blank material is then printed 115 to a second fabric and the second printed fabric is cut 117 to a size so to act as a removeable cover over the first fabric on the upholstered furniture. In other embodiments the second fabric can replace the first fabric. Those skilled in the art will recognize that this process enables multiple images to be printed onto 1-item of furniture e.g., a stool, table, chair seat or other furniture item.

Thus, in another embodiments, a slip cover of smooth material can be placed over a foam core and/or base. A foam core can also be treated with a coating material to allow a cover to be slipped over and removed multiple times without degrading the foam surface. In the event no wood base is used, the product can be fit with a customizable encapsulating cover with a removable zipper or other closing mechanism. This arrangement acts as a first cover. When a change to the furniture's finished cosmetic design/pattern is desired, the first cover can be removed, replaced and/or exchanged. If needed, it can be reused again in the future. Thus, the user can have as many covers as they like, continually changing the finished look of the product as many or few times as desired.

The methods as described herein offer an economic, health and sustainability advantages since there is no need to take furniture for reupholstery. The decorative covering of the finished product can be easily changed as desired. Moreover, less material ends up in a landfill and it can be easy washed to avoid health concerns.

In still further embodiments where a wood core or base is used, there can be two options based upon a user's desired look or appearance. If they are unlikely to change the cover frequently, a furniture unit can be fully upholstered with a fixed first finish with the ability to add a future cover over-top of the first finished unit and updated as needed using the foregoing process. Thus, the present invention works not merely as a blanket cover or overlay but instead is a means by which upholstery can be easily be updated, removed, and/or substituted by the user.

Hence the invention is a method and/or process where a fabric furniture covering is manufactured using the steps of selecting a desired color image which is at least one of a printed pattern, photo or artistic design. A transfer paper is then heated to a predetermined temperature and the desired image is printed on/to a transfer paper using a reverse image of the desired image, where the desired image is set onto the transfer paper based on time applied and pressure of the first fabric to the transfer paper.

The transfer paper is then laid on top of a first fabric in a continuous production process for continually transferring at least one selected image to the transfer paper. Both heat and required pressure are simultaneously applied to the first fabric over time such that an ink dye from the transfer paper is transferred to the first fabric in order to permanently dye fibers in the first fabric to their core. The first fabric is then cut to a predetermined size and shape where it is upholstered to the upholstering the cut first fabric directly to furniture. A second pattern can then be printed to a second fabric by repeating steps the above steps. Finally, the second printed fabric is cut to a predetermined size so to act as a removeable cover over the first fabric on the upholstered furniture.

Figure 2A:
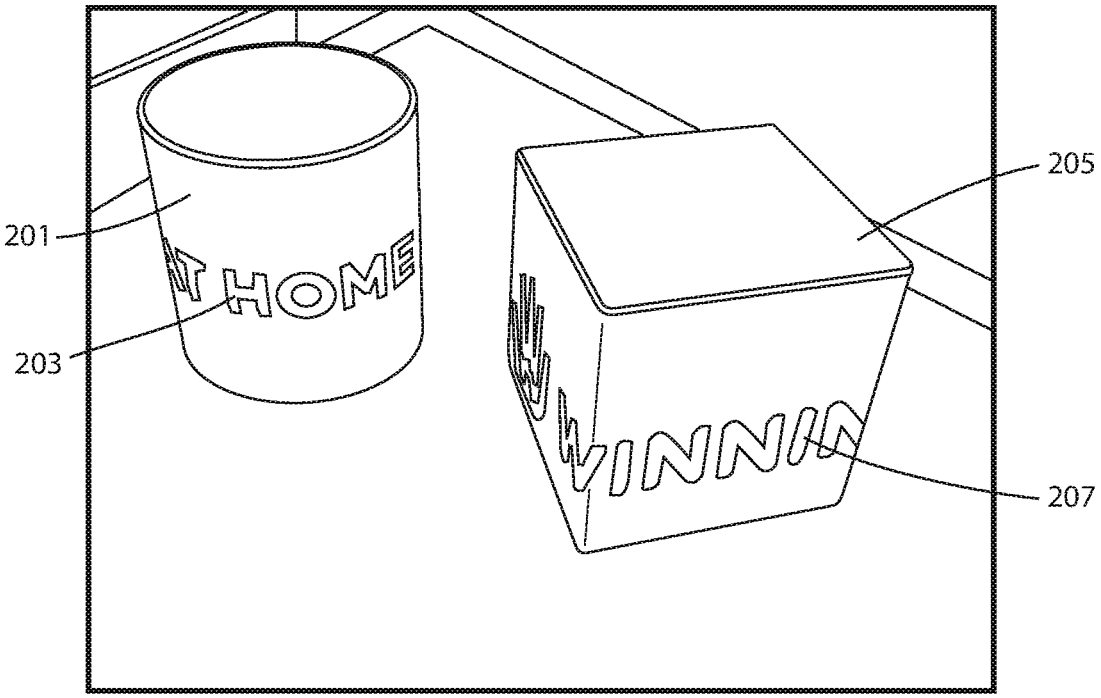
FIG. 2A illustrates a first upholstered foot stool using the processes to apply fabric furniture coverings according to various embodiments of the invention.
Figure 2B:
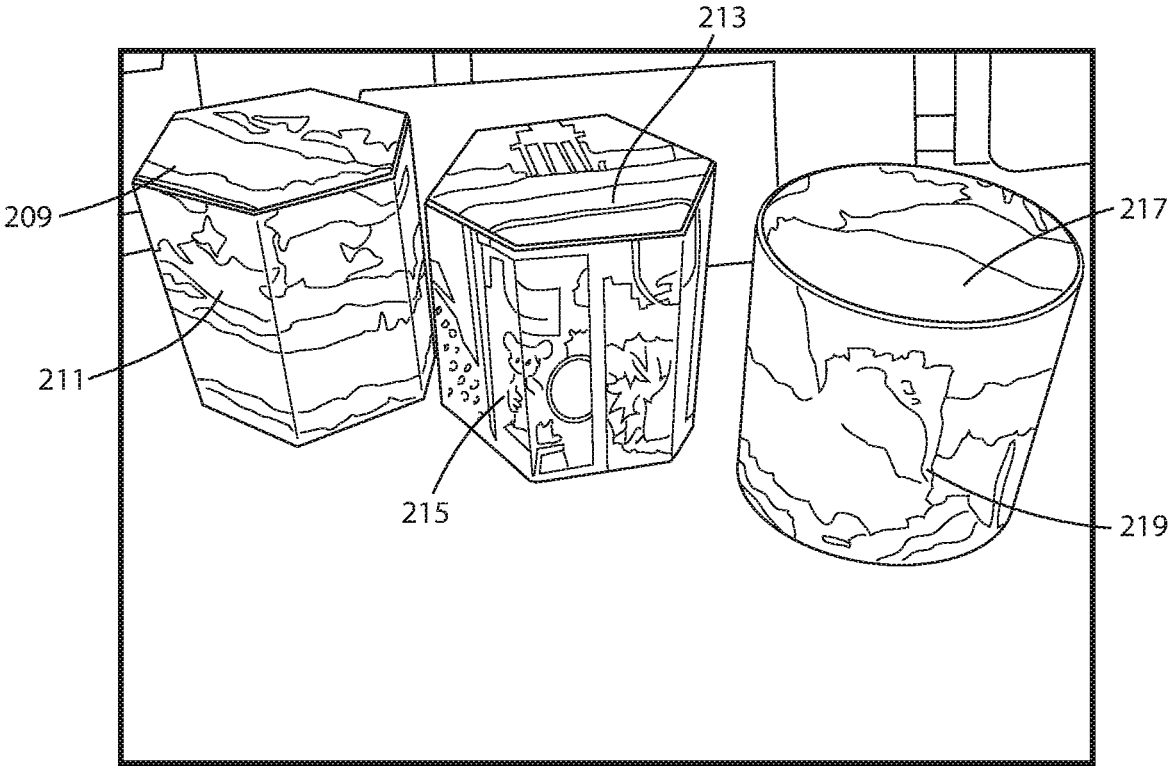
FIG. 2B illustrates a second upholstered table foot stool using fabric furniture coverings according to various embodiments of the invention.

FIG. 2A and FIG. 2B are illustrations showing a multi-use poufs 200*a* and ottomans and footstools 200*b* shown in various shapes using the process for producing printed fabric coverings as described herein. FIG. 2A illustrates a round pouf 201 that includes a decorative upholstered covering using an image 203 printed using the processes herein. A square pouf 205 is also shown having an upholstered image 207. FIG. 2B illustrates hexagonal ottomans 209, 213 including upholstered images 211, 215 applied using the processes herein. Finally, a round ottoman 217 includes upholstered image 219.

Thus, the present invention overcomes many challenges as compared to prior art processes for example, since the material can be sublimated where unique temperatures are used in the process to compensate for shrink rates in horizontal and vertical directions. Additionally, sewing alignment features, e.g. notching, is added for sewing assists that are needed to compensate for fabric shrinkage as well as print placement on the fabric. Further, the smaller size of the material often requires adjustments to tensioning systems on equipment and a unique cutting process is required e.g. laser cutters to cut the fabric due to dimensional tolerances required. Variations in color offer challenges and a color profile based on fabric type. Since art templates can be set up specifically for parameters of a particular program, Pantone colors are designated for specific designs. Designs without designated Pantone colors required unique settings to prevent over-saturation from the dye on the fabric. In the present invention, these challenges are overcome while simultaneously using a fabric that combines a soft feel and a durable and/or cleanable protective coating while still being printable.

Those skilled in the art will recognize that the product-by-process as described in the present invention has many advantages over current furniture product offerings. These include, stain resistance and washability of the printed fabric viz. both indoor and outdoor. Additionally, the process allows use of fabric having longer longevity, odor protection and resistance. The fabric may also include a grippy bottom and is slip resistant for added stability for enhancing safety of the stool. The fabric can include a hidden zipper for fabric removal and cleaning. The zipper may also include a shroud that hides the sides of the zipper and pull. Although Silver-tex™ vinyl can be used in this process, a combination of fabrics and knitted fabrics and treated and/or textured fabrics can be also used for therapeutic assists. For example, different textures may be used on each side of the fabric for allowing the pouf or stool to be customized as desired. Further, when used with smaller furniture, a frameless construction is used which is lightweight and can be easily moved and transported. In one embodiment, a one density solution is offered where an engineered foam having specialized or multi-density and/or multi-hardness can be used for comfort and stability. Polyester or one piece of solid foam, Styrofoam (EPP) can be used where the stool's inner core can vary in stability and weight. Thus, the fabric furniture coverings manufactured using the process as described herein allows for vast improvements in furniture design by allowing the user to select printing patterns and/or photos as needed.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

We claim:

1. A fabric furniture covering manufactured using the process of:

a) selecting a desired image which is at least one of a printed pattern, photo or artistic design;
b) printing the desired image to a transfer paper using a reverse of the desired image where the desired image is set to the transfer paper based on the heating temperature of the transfer paper, time applied and pressure of the first fabric to the transfer paper;
c) laying the transfer paper on top of a first fabric in a continuous production process;
d) simultaneously applying both heat and required pressure to the first fabric over time such that an ink dye is transferred to the first fabric in order to permanently dye fibers in the first fabric to their core;
e) cutting the first fabric to a predetermined size;
f) upholstering the cut first fabric directly to furniture or to a removeable first cover;
g) printing a second pattern to a second fabric by repeating steps a) though f); and
h) cutting the second printed fabric to a predetermined size so to act as a removeable cover over the first fabric on the upholstered furniture.

2. A fabric furniture covering manufactured using the process of claim 1, where the removeable cover is replacement cover.

3. A fabric furniture covering manufactured using the process of:

a) selecting a desired color image which is at least one of a printed pattern, photo or artistic design;

b) heating a transfer paper to a predetermined temperature;

c) printing the desired image to a transfer paper using a reverse of the desired image where the desired image is set to the transfer paper based on time applied and pressure of the first fabric to the transfer paper;

d) laying the transfer paper on top of a first fabric in a continuous production process for continually transfer selected images to the transfer paper;

e) simultaneously applying both heat and required pressure to the first fabric over time such that an ink dye from the transfer paper is transferred to the first fabric in order to permanently dye fibers in the first fabric to their core;

f) cutting the first fabric to a predetermined size and shape;

g) upholstering the cut first fabric directly to furniture;

h) printing a second pattern to a second fabric by repeating steps a) though f); and i) cutting the second printed fabric to a predetermined size so to act as a removeable cover over the first fabric on the upholstered furniture.

4. The fabric furniture covering manufactured using the process as in claim 3, wherein the removeable cover is a replacement cover configured in place of the first fabric.

* * * * *